United States Patent [19]

Fujiwara

[11] Patent Number: 4,643,922

[45] Date of Patent: Feb. 17, 1987

[54] ROCKING TURTLE WITH NO LEGS

[76] Inventor: James M. Fujiwara, 1955 A Aupuni St., Honolulu, Hi. 96917

[21] Appl. No.: 763,834

[22] Filed: Aug. 8, 1985

[51] Int. Cl.[4] ..... A63H 3/00

[52] U.S. Cl. ..... 428/16; D21/157; 428/537.1; 446/325; 446/368; 446/396

[58] Field of Search ..... D11/134; D21/157; 446/325, 396, 368; 428/16, 537.1, 542.2

[56] References Cited

U.S. PATENT DOCUMENTS

| | | | |
|---|---|---|---|
| D. 188,841 | 9/1960 | Baxter, Jr. | 446/368 X |
| D. 233,461 | 10/1974 | Langieri et al. | D21/157 X |
| D. 245,805 | 9/1977 | Cone | D21/157 |
| 699,780 | 5/1902 | Woerner | 446/368 X |
| 1,591,905 | 7/1926 | Williams | 428/16 X |
| 2,181,024 | 11/1939 | Pifalo | 446/368 |
| 2,583,061 | 1/1952 | Reed | 446/325 |
| 2,786,303 | 3/1957 | Zimmerman | 446/368 |
| 3,763,592 | 10/1973 | Den Ouden | 428/16 X |

FOREIGN PATENT DOCUMENTS

| | | | |
|---|---|---|---|
| 261656 | 8/1949 | Switzerland | 446/368 |

*Primary Examiner*—Henry F. Epstein
*Attorney, Agent, or Firm*—Richard L. Miller

[57] ABSTRACT

This invention is a turtle-shaped figurine that includes an arcuately rounded underside surface positioned for rocking the turtle forwardly-rearwardly about a transverse axis.

3 Claims, 5 Drawing Figures

ROCKING TURTLE WITH NO LEGS

BACKGROUND OF THE INVENTION

This invention relates generally to decorative figurines. More specifically it relates to action-animated figurines.

It is well known that numerous persons like to display decorative statuary and figurines in their homes or gardens, and many such articles have accordingly been designed in the past. Their designs include all forms of realistic and also abstract shapes, and may be classical, religious or whimsical representations.

SUMMARY OF THE INVENTION

It is a principal object of the present invention to provide a figurine of a turtle having no legs and which is able to be rocked.

Another object is to provide a rocking turtle with no legs that can be made in any desired size so that it would adaptable for display either as a large garden statuary, a small decoration upon a desk or shelf, or the like.

Yet another object is to provide a rocking turtle with no legs which is made of wood or suitable material so that it is adaptable for floating upon water.

Other objects are to provide a rocking turtle with no legs which is artistic in appearance, easy to carve into shape and which may also serve useful either as a weight or a symbol; it is being noted that the Oriental people believe the turtle represents good health and long life.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

Figure 1:
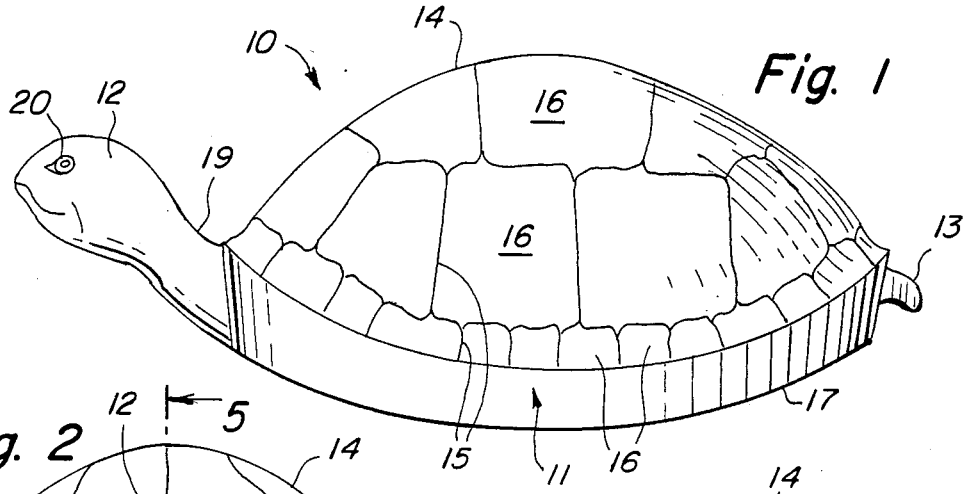
FIG. 1 is a side elevational view of the invention.
Figure 2:
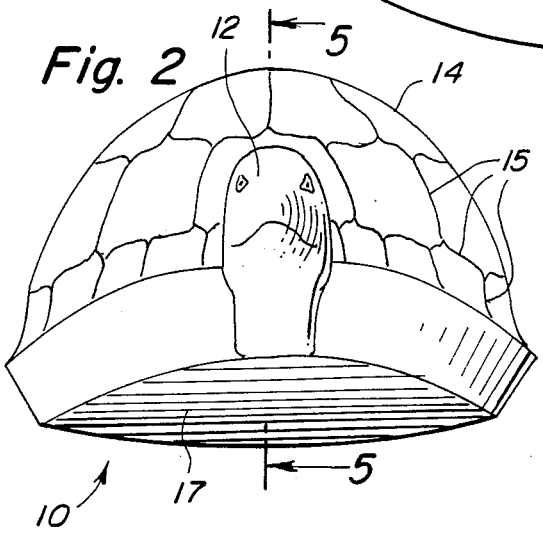
FIG. 2 is a front elevational view thereof.
Figure 3:
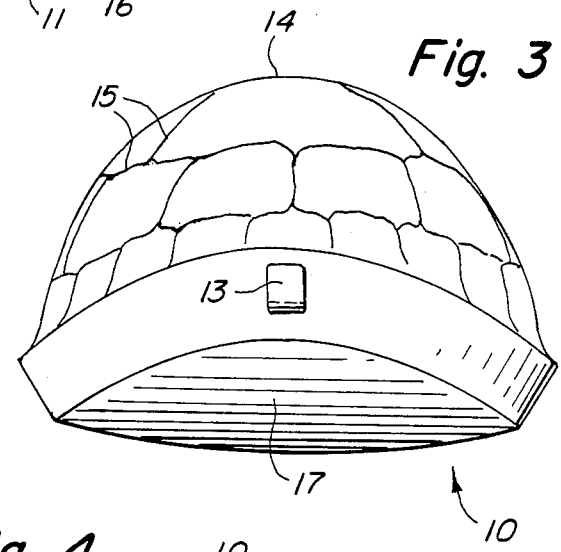
FIG. 3 is a rear elevational view.

It will be noted from the figures in the drawing, that there is an arcuate curvature in the longitudinal direction as shown in FIG. 1. However, there is also an arcuate base portion in the transverse direction as shown in FIGS. 2 and 3. As a result, the figurine will rock both back and forth in the longitudinal direction and will also provide a rocking motion in the transverse direction.

Figure 5:
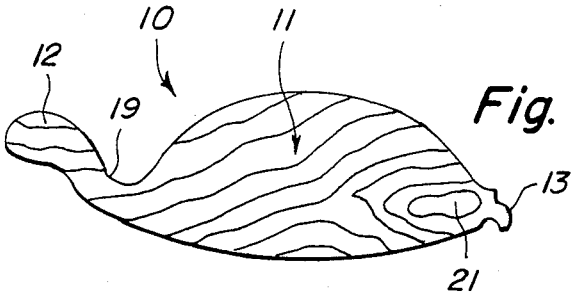

FIG. 5 is a cross sectional view taken on line 5—5 of FIG. 2, illustrating that the device may be carved or fabricated out of nonhomogeneous materials so that it may float or rock in a more desirable fashion.

DETAILED DESCRIPTION OF THE PREFERRED EMBODIMENTS

Referring now to the Drawing in greater detail, the reference numeral 10 represents a rocking turtle with no legs, according to the present invention, wherein the same comprises a one piece member that is either carved from a solid block of wood or fabricated of nonhomogeneous substance. It may be made in any size, and includes a body 11 having a head 12 at one end and a tail 13 at its opposite end. The body is generally hemispherically upwardly rounded and its upper surface 14 is carved with grooves 15 so that it resembles plates 16 of a conventional turtle shell. The underside surface 17 of the body is arcuately contoured so that the body can be rocked in forwardly-rearwardly direction when either rested upon a solid support surface 18 or when floated in water. A neck 19 is formed between the body and the head. A drilled socket on each side of the head has a plastic bead 20 installed therein so as to represent eyes. The tail is downwardly curved so as to be hook shaped, as shown. After being thus shaped, the turtle figurine is stained in any desired color and is covered with three coats of urethane plastic in glossy or satin finish.

Figure 4:
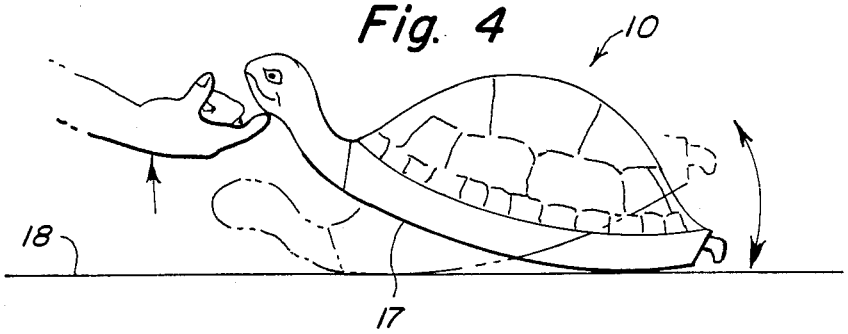
FIG. 4 is a side view showing the device being rocked when either floated on water or placed upon a flat solid surface.

In use, application of a force either to the head or tail, as shown in FIG. 4 will cause the turtle to then rock back and forth while after being released.

As shown in FIG. 5, for a better rocking balance, the turtle is carved so that a large knot 21 in the wood is at the tail end of the figurine in order that the small tail counterbalances the relatively larger head and neck; wood knots being more dense and heavier than a rest of the wood.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A rocking turtle figurine, comprising, in combination, an elongated one piece member having a body portion, a large head portion longitudinally extending generally horizontally from one end thereof, and a smaller tail portion longitudinally extending generally horizontally from an opposite end thereof, said body portion having an arcuately curved surface on its underside along its longitudinal direction as well as along its transverse direction for rocking, said turtle including balancing means at its tail end for counter-balancing the larger head portion to permit said rocking, said one piece member being of wood material, and said balancing means being a wood knot integral of the wood and being at the tail end of the figurine.

2. The combination as set forth in claim 1, wherein a neck portion is formed between said body portion and said head portion.

3. The combination as set forth in claim 2, wherein a socket on each side of said head portion is fitted with a plastic bead for representing eyes.

* * * * *